US006434888B1

(12) United States Patent
Shaw et al.

(10) Patent No.: US 6,434,888 B1
(45) Date of Patent: Aug. 20, 2002

(54) DOOR GAP FINGER GUARD

(76) Inventors: William Shaw, 41 El Cerrito, San Anselmo, CA (US) 94960; Wayne Carson, 2439 Norton St., Napa, CA (US) 94558

( * ) Notice: Subject to any disclaimer, the term of this patent is extended or adjusted under 35 U.S.C. 154(b) by 0 days.

(21) Appl. No.: 09/817,537

(22) Filed: Mar. 26, 2001

(51) Int. Cl.[7] ..... E05D 11/00
(52) U.S. Cl. ..... 049/383; 16/258
(58) Field of Search ..... 49/383; 16/258; 52/741.1

(56) References Cited

U.S. PATENT DOCUMENTS 2,910,741 A * 11/1959 Dettman
2,995,785 A * 8/1961 Hallenbeck
3,319,697 A * 5/1967 Krohn
4,040,142 A * 8/1977 Ippolito ..... 16/137
4,344,253 A * 8/1982 Stiles ..... 49/383
5,092,077 A * 3/1992 Teinturier-Milgram ..... 49/383
5,220,708 A * 6/1993 Lucas et al. ..... 16/225
5,419,084 A * 5/1995 Sankey et al. ..... 49/383
6,029,409 A * 2/2000 Wilson ..... 52/202
6,134,839 A * 10/2000 Johansson ..... 49/383
6,141,909 A * 11/2000 Hanson ..... 49/303
6,298,605 B1 * 10/2001 Delefosse et al. ..... 49/383
6,308,474 B1 * 10/2001 Wilson ..... 52/202
6,311,432 B1 * 11/2001 Watson ..... 49/383

* cited by examiner

*Primary Examiner*—Curtis A. Cohen
(74) *Attorney, Agent, or Firm*—Jack Lo

(57) ABSTRACT

The present door gap finger guard is comprised of an elongated rigid fixed plate connected to an elongated rigid movable plate by a narrow springy strip. The fixed plate, springy strip, and movable plate are coplanar when relaxed. The fixed plate is adapted to be attached to an interior surface of a doorjamb, and the movable plate is adapted to be biased against a door hinged to the door jamb. Both plates are transparent for blending in with the surrounding architecture. The movable plate is biased against the door regardless of the door's position to cover the door gap at all times. The springy strip is significantly narrower than either the movable plate or the fixed plate, so that most of the guard is of a rigid material that cannot be collapsed when pushed upon for preventing fingers from getting into the door gap.

18 Claims, 2 Drawing Sheets

DOOR GAP FINGER GUARD

BACKGROUND OF THE INVENTION

1. Field of the Invention

This invention relates generally to guards for preventing fingers from being crushed in door gaps.

2. Prior Art

When a door is opened, a gap is created between the hinged edge of the door and the door jamb. When the door is closed, any soft object that is placed in the gap would be crushed by the powerful leverage of the door. The force produced at the door gap is many timers greater than at the outer edge of the door. Fingers are thus sometime seriously injured in door gaps. Young children are particularly susceptible because they explore their environments by touch. Adults sometimes unknowingly close doors on children's fingers when the children are hidden behind the doors.

Many door gap guards are disclosed among the prior art, but they all suffer from one or more drawbacks. A guard disclosed in U.S. Pat. 5,778,601 to Wu is comprised of a rigid curved panel with one edge hinged to a doorjamb, and another edge slidably connected to a rail attached on a door. Installation is relatively cumbersome because fasteners are required along both sides of the guard. Any misalignment between the panel and the rail can cause the guard to bind when the door is pivoted. In another embodiment, the panel has a free edge that is biased against the door by a spring, which adds an additional part. In both embodiments, the hinges must be made by expensive injection molding.

A guard disclosed in U.S. Pat. No. 5,765,311 to Kapler is comprised of a L-shaped panel with one end hinged to a doorjamb, and another end biased against a door by springs. The separate hinges and springs require relatively labor intensive assembly and installation. A guard disclosed in U.S. Pat. No. 4,344,253 to Stiles is comprised of a stationary U-shaped member attached to a door jamb and positioned across the door gap. The stationary U-shaped member does not follow the door, so that the gap is still exposed when the door is fully opened.

A guard disclosed in U.S. Pat. No. 3,384,996 to Gilchrist et al. is comprised of a flexible sheet with one edge attached to a doorjamb, and another edge biased against the door. Other guards disclosed in U.S. Pat. No. 4,261,140 to McLean, U.S. Pat. No. 613,592 to Nagley, and U.S. Pat. No. 474,633 to Glazier are each comprised of a pair of bars respectively attached to the doorjamb and the door, and a flexible sheet connected between the bars. In each of these guards, the sheet is very wide and flexible. It will deform and collapse into the door gap when it is pushed upon by a finger, so that the finger can still get into the door gap and get hurt.

OBJECTIVES OF THE INVENTION

Accordingly, the objectives of the present door gap finger guard are:

- to cover the door gap and thus prevent fingers or other objects from getting in;
- to follow door movements and cover the gap at all times;
- to not deform or collapse when pushed upon to prevent fingers from getting into the door gap;
- to blend in with the surrounding architecture;
- to be very simple to manufacture; and
- to be very simple to install.

Further objectives of the present invention will become apparent from a consideration of the drawings and ensuing description.

BRIEF SUMMARY OF THE INVENTION

The present door gap finger guard is comprised of an elongated rigid fixed plate connected to an elongated rigid movable plate by a narrow springy strip. The fixed plate, springy strip, and movable plate are coplanar when relaxed. The fixed plate is adapted to be attached to an interior surface of a doorjamb, and the movable plate is adapted to be biased against a door hinged to the doorjamb. Both plates are transparent for blending in with the surrounding architecture. The movable plate is biased against the door regardless of the door's position to cover the door gap at all times. The springy strip is significantly narrower than either the movable plate or the fixed plate, so that most of the guard is of a rigid material that cannot be collapsed when pushed upon for preventing fingers from getting into the door gap.

DRAWING REFERENCE NUMERALS

10. Fixed Plate
11. Movable Plate
12. Springy Strip
13. Outer Edge
14. Holes
15. Door Jamb
16. Interior Surface
17. Door
18. Screws
19. Door Gap

DETAILED DESCRIPTION OF THE INVENTION

Figure 1:
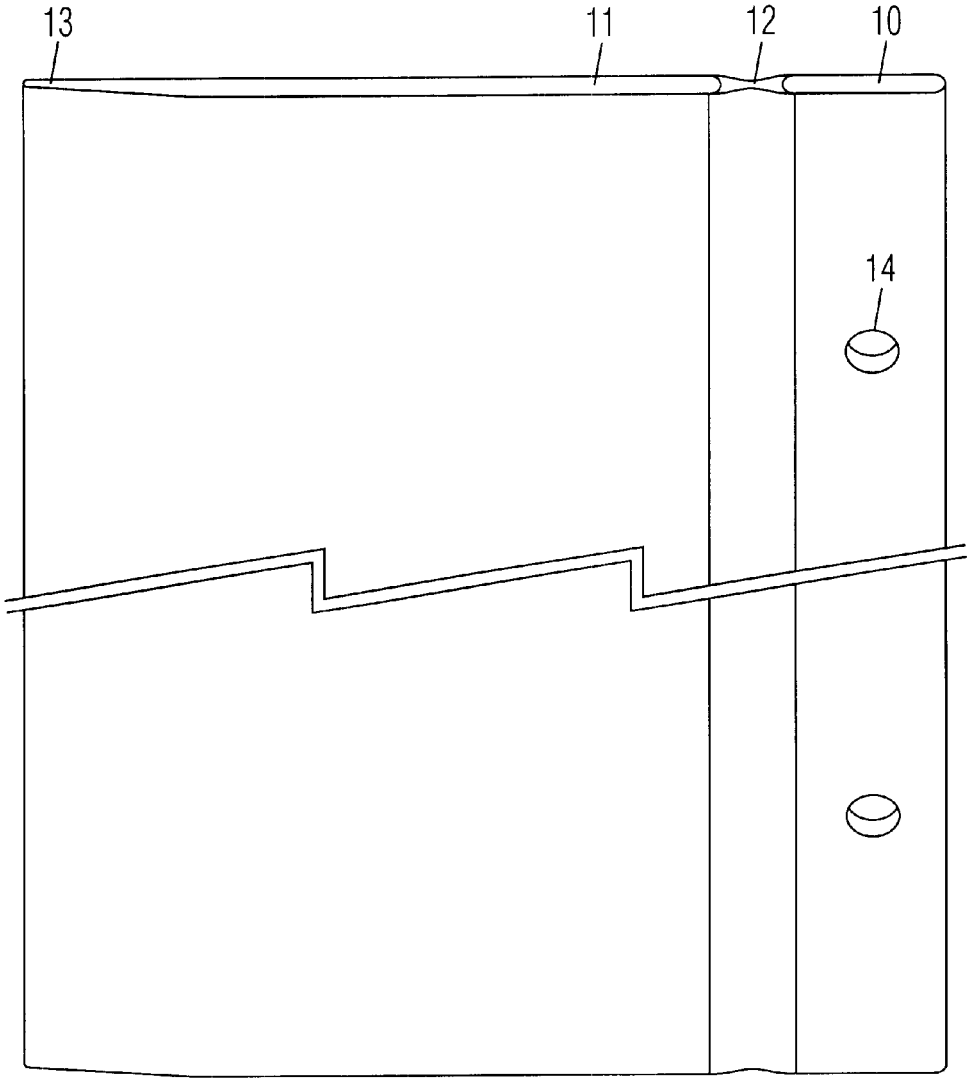
FIG. 1 is a front perspective view of the present door gap finger guard.
Figure 2:
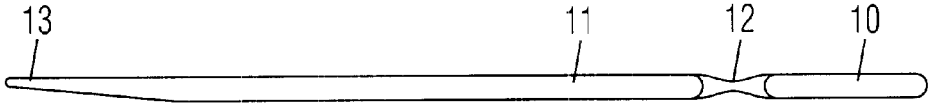
FIG. 2 is an edge-on view thereof.

FIGS. 1–2:

A preferred embodiment of the present door gap finger guard is shown in a front perspective view in FIG. 1 and an edge-on view in FIG. 2. It is comprised of an elongated rigid fixed plate 10 connected to an elongated rigid movable plate 11 by a narrow springy strip 12. The opposite longitudinal edges of fixed plate 10 and movable plate 11 are preferably rounded. An outer edge 13 of movable plate 11 is preferably beveled on one side. Springy strip 12 is provided with a constricted center portion for facilitating flexing.

Fixed plate 10 and movable plate 11 are made of a rigid material, such as rigid plastic. They are preferably made of a generally transparent hard plastic, such as acrylic, for enabling the colors of the doorjamb and door to show through and thus be as inconspicuous as possible. Springy strip 12 is preferably made of a springy plastic, such as polyurethane. Although the rigid plates and the springy strip are made of different materials, they can be and are preferably molded as a single part to completely eliminate the need for assembly. Fixed plate 10, springy strip 12, and movable plate 11 are coplanar when relaxed, so that movable plate 11 will resist movement to either side. A plurality of holes 14 are provided along fixed plate 10 for receiving screws.

For most residential installations, fixed plate 10 is preferably about 0.8 inch (2 cm) wide and movable plate 11 is preferably about 3 inches (7.6 cm) wide. Both plates are preferably about 0.13 inch (3.3 mm) to 0.19 inch (4.8 mm) thick. Springy strip 12 is preferably about 0.5 (1.3 cm) wide. The guard is preferably long enough, such as 4 feet (1.22 m), to cover the section of a door gap which is reachable by young children.

Figure 3:
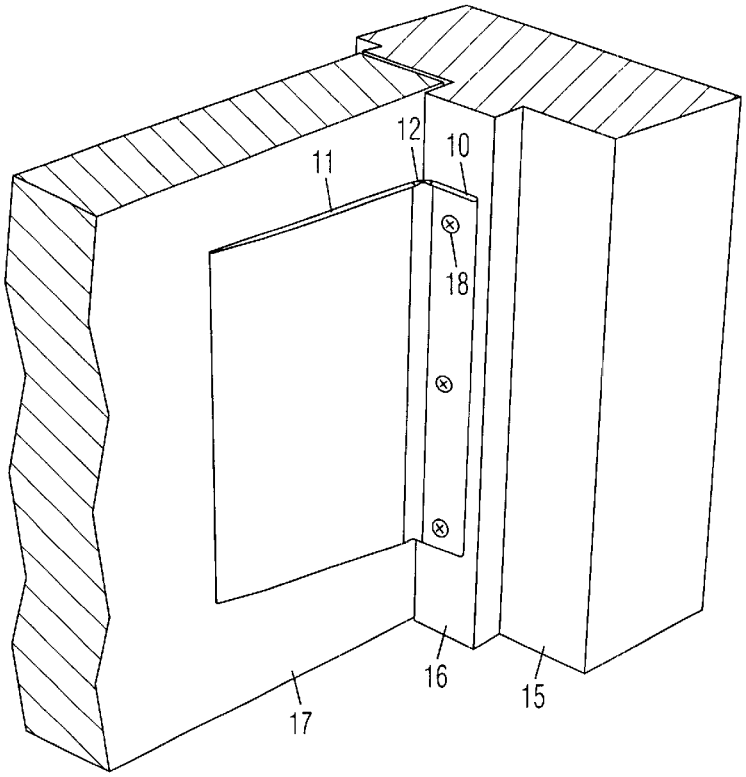
FIG. 3 is a perspective view thereof attached to a doorjamb when the door is closed.

FIGS. 3–4:

The door gap finger guard is shown attached to a doorjamb 15 in FIG. 3. Fixed plate 10 is adapted to be fixedly attached to an inner surface 16 of doorjamb 15, and movable plate 11 is adapted to be biased against a door 17 hinged to doorjamb 15. Door 17 is perpendicular to inner surface 16 of doorjamb 15 when closed. Fixed plate 10 may be attached with screws 18 as shown, or it may be attached with other another type of fastener, such as glue, double-sided mounting tape, etc. Installation is easy because only one edge of the finger guard is attached. When door 17 is closed as shown, movable plate 11 is at about 90 degrees to fixed plate 10. Although the door guard is shown positioned on the side of door 17 such that the door is moved toward it when the door is closed, it can be attached to the other side of the door if necessary.

Figure 4:
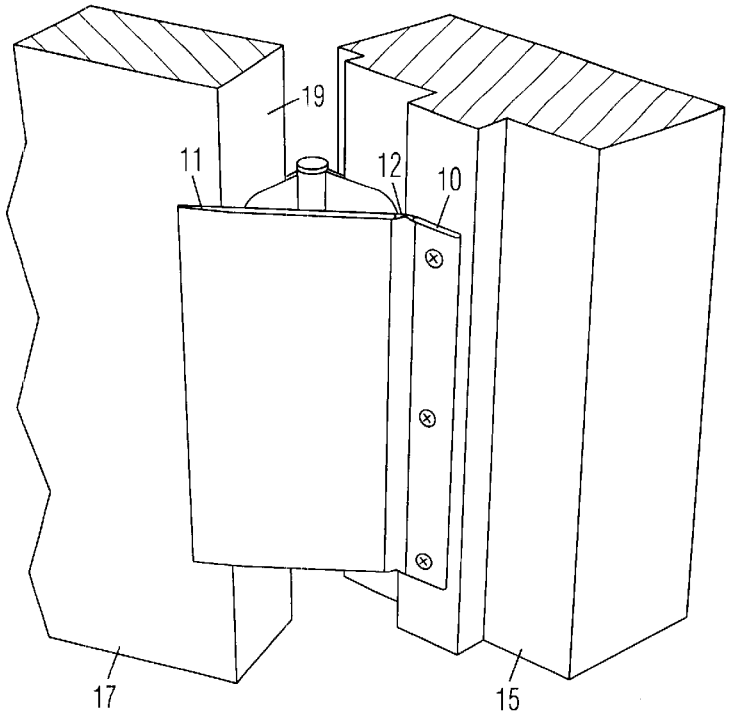
FIG. 4 is a perspective view thereof attached to the doorjamb when the door is opened.

As shown in FIG. 4, movable plate 11 is continuously biased against door 17 by springy strip 12 regardless of the door's position to cover a door gap 19 at all times. Movable plate 11 is long enough to fully cover door gap 19 even when door 17 is fully open. Springy strip 12 is springy enough to bias movable plate 11 against door 17 in all door positions, and yet soft enough to not resist door closing or move the door on its own. Springy strip 12 is significantly narrower than either movable plate 11 or fixed plate 10, so that most of the guard is of a rigid material that cannot be collapsed when pushed upon by fingers for preventing the fingers from getting into door gap.

For clarity, only a short portion of the finger guard is shown. In actual use, the lower end of the finger guard is preferably even with the bottom of door 17, and the top of the finger guard is preferably high enough to cover the section of door gap 19 which is reachable by young children.

SUMMARY AND SCOPE

Accordingly, the present door gap finger guard covers the door gap and thus prevent fingers or other objects from getting in. It follows door movements and cover the gap at all times. It does not deform or collapse when pushed upon to prevent fingers from getting into the door gap. It blends in with the surrounding architecture. It is very simple to manufacture. It is also very simple to install.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

We claim:

1. A door gap finger guard, comprising:

an elongated rigid fixed plate adapted to be fixedly attached along an inner surface of a door jamb;

an elongated rigid movable plate extending along a parallel direction to said rigid fixed plate when said movable plate is relaxed, said movable plate terminating in an unattached free edge; and a springy strip connected between adjacent edges of said rigid fixed plate and said rigid movable plate; wherein said free edge of said rigid movable plate is adapted to be biased against a door and slide against said door at all door angles solely by said springy strip to cover a gap between said door and said door jamb; and said springy strip is narrower than said rigid fixed plate and said rigid movable plate for reducing a deformable area of said finger guard and thus resisting intrusion.

2. The door gap finger guard of claim 1, wherein said rigid fixed plate, said rigid movable plate, and said springy strip are generally coplanar when relaxed, so that said rigid movable plate resists movement to either side.

3. The door gap finger guard of claim 1, wherein said springy strip has a constricted center portion for facilitating flexing.

4. The door gap finger guard of claim 1, wherein said springy strip is made of polyurethane for springiness.

5. The door gap finger guard of claim 1, wherein outer longitudinal edges of said rigid fixed plate and said rigid movable plate are rounded for safety.

6. The door gap finger guard of claim 1, wherein said rigid fixed plate is about 0.8 inch (2 cm) wide, said rigid movable plate is about 3 inches (7.6 cm) wide, and said springy strip 12 is about 0.5 (1.3 cm) wide.

7. The door gap finger guard of claim 1, wherein said rigid fixed plate, said rigid movable plate, and said springy strip are at least about 4 feet (1.22 m) long to cover a section of said gap which is reachable by children.

8. The door gap finger guard of claim 1, further including a plurality of holes along said rigid fixed plate adapted to receive screws.

9. A door gap finger guard, comprising:

an elongated rigid fixed plate adapted to be fixedly attached along an inner surface of a door jamb;

an elongated rigid movable plate extending along a parallel direction to said rigid fixed plate when said movable plate is relaxed, said movable plate terminating in an unattached free edge; and a springy strip connected between adjacent edges of said rigid fixed plate and said rigid movable plate; wherein said free edge of said rigid movable plate is adapted to be biased against a door and slide against said door at all door angles solely by said springy strip to cover a gap between said door and said door jamb; and said springy strip is narrower than said rigid fixed plate and said rigid movable plate for reducing a deformable area of said finger guard and thus resisting intrusion;

said rigid fixed plate and said rigid movable plate are comprised of a generally transparent plastic for enabling colors of said doorjamb and said door to show through and thus be inconspicuous.

10. The door gap finger guard of claim 9, wherein said rigid fixed plate, said rigid movable plate, and said springy strip are generally coplanar when relaxed, so that said movable plate resists movement to either side.

11. The door gap finger guard of claim 9, wherein said springy strip has a constricted center portion for facilitating flexing.

12. The door gap finger guard of claim 9, wherein said springy strip is made of polyurethane for springiness.

13. The door gap finger guard of claim 9, wherein outer longitudinal edges of said rigid fixed plate and said rigid movable plate are rounded for safety.

14. The door gap finger guard of claim 9, wherein said rigid fixed plate is about 0.8 inch (2 cm) wide, said rigid movable plate is about 3 inches (7.6 cm) wide, and said springy strip 12 is about 0.5 (1.3 cm) wide.

15. The door gap finger guard of claim 9, wherein said rigid fixed plate, said rigid movable plate, and said springy strip are at least about 4 feet (1.22 m) long to cover a section of said gap which is reachable by children.

16. The door gap finger guard of claim 9, further including a plurality of holes along said rigid fixed plate adapted to receive screws.

17. A method for covering a door gap, comprising the steps of:

providing an elongated door gap finger guard comprising a rigid fixed plate, a rigid movable plate, and a narrower springy strip connected between said rigid fixed plate and said rigid movable plate, said rigid movable plate terminating in an unattached free edge, wherein said rigid fixed plate, said rigid movable plate, and said springy strip are generally coplanar when relaxed;

positioning said door gap finger guard vertically with said rigid fixed plate against an inner surface of a door jamb which is perpendicular to a door hinged to said door jamb and which is exposed when said door is closed, and positioning said free edge of said rigid movable plate against said door; and attaching said rigid fixed plate to said inner surface of said door jamb, but leaving said free edge of said rigid movable plate biased against said door solely by said springy strip for easing installation.

18. The method of claim 17, further including molding said rigid fixed plate, said rigid movable plate, and said springy strip as a single part to eliminate any assembly of said door gap finger guard.

* * * * *